US006797909B2

(12) United States Patent
Pride et al.

(10) Patent No.: US 6,797,909 B2
(45) Date of Patent: Sep. 28, 2004

(54) HIGH-VOLTAGE LOADBREAK SWITCH WITH ENHANCED ARC SUPPRESSION

(75) Inventors: Patrick Harold Pride, Mukwonago, WI (US); Joseph Peter Gerovac, Menomonee Falls, WI (US); Paul Steven Kozicki, Hales Corners, WI (US); Allen Leroy Johnson, Mukwonago, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/374,724

(22) Filed: Feb. 27, 2003

(65) Prior Publication Data

US 2004/0169014 A1 Sep. 2, 2004

(51) Int. Cl.[7] ..... H01H 9/30; H01H 33/04; H01H 33/70; H01H 33/88

(52) U.S. Cl. ..... 218/1; 218/85; 218/89; 218/92; 218/101; 218/113; 218/152

(58) Field of Search ..... 200/14, 15, 18; 218/1, 5, 7, 43, 44, 70, 71, 84, 85, 89–116, 152–154

(56) References Cited

U.S. PATENT DOCUMENTS

| | | | | | |
|---|---|---|---|---|---|
| 707,505 | A | * | 8/1902 | Elden | 218/101 X |
| 1,543,495 | A | * | 6/1925 | Bowie | 218/113 |
| 4,110,584 | A | | 8/1978 | Erickson et al. | |
| 4,177,368 | A | | 12/1979 | Erickson | |
| 4,263,487 | A | | 4/1981 | Welter et al. | |
| 4,289,941 | A | | 9/1981 | Cannon | |
| 4,342,889 | A | | 8/1982 | Welter | |
| 4,417,112 | A | | 11/1983 | Kueenzle et al. | |
| 4,460,813 | A | | 7/1984 | Kueenzle et al. | |
| 4,484,046 | A | | 11/1984 | Neuhouser | |
| 4,510,360 | A | * | 4/1985 | Golub | 218/117 |
| 4,591,679 | A | | 5/1986 | Yamat et al. | |
| 4,663,504 | A | | 5/1987 | Barkan | |
| 4,956,742 | A | | 9/1990 | Takagi et al. | |
| 5,084,600 | A | | 1/1992 | Seki et al. | |
| 5,266,041 | A | | 11/1993 | De Luca | |
| 5,276,288 | A | | 1/1994 | Erickson et al. | |
| 5,464,956 | A | | 11/1995 | Steele et al. | |
| 5,521,567 | A | | 5/1996 | Devonald, III et al. | |
| 6,075,218 | A | | 6/2000 | Trautmann et al. | |

* cited by examiner

*Primary Examiner*—James R. Scott
(74) *Attorney, Agent, or Firm*—Fish & Richardson P.C.

(57) ABSTRACT

A high-voltage loadbreak switch operates submersed in a dielectric fluid and may be configured to switch one or more phases of power using one or more phase switches. Each phase switch may include first and second stationary contacts. The first stationary contact may be connected to a phase of a high-voltage power source. Each phase switch also may include a non-stationary contact. The non-stationary contact may be placed in a first position to electrically couple the first stationary contact to the second stationary contact, and in a second position to decouple the first stationary contact and the second stationary contact. The region of motion of the first non-stationary contact between the first position and the second position includes an arcing region. The high-voltage loadbreak switch uses a fluid circulation mechanism to improve circulation of the dielectric fluid through the arcing region. To suppress arcing between different phases, a non-conductive baffle may separate different phase switches when more than one phase switch is used. A non-conductive baffle also may separate a phase from ground to prevent phase-to-ground arcing.

26 Claims, 7 Drawing Sheets

HIGH-VOLTAGE LOADBREAK SWITCH WITH ENHANCED ARC SUPPRESSION

TECHNICAL FIELD

This description relates to high-voltage electrical switches.

BACKGROUND

Loadbreak switches, sometimes referred to as selector or sectionalizing switches, are used in high-voltage operations to connect one or more power sources to a load. High-voltage operations generally include those that employ voltages higher than 1,000 volts. Loadbreak switches may be used to switch between alternate power sources to allow, for example, reconfiguration of a power distribution system or use of a temporary power source while a main power source is serviced.

A loadbreak switch often must be compact in view of its intended uses (e.g., in an underground distribution installation, and/or in a poly-phase industrial installation internal to a distribution or power transformer or switchgear). The compact size of a loadbreak switch reduces the physical distance achievable between electrical contacts of the switching mechanism. The reduced physical distance between the electrical contacts, in turn, may make the switch vulnerable to sustained arcing in view of the high-voltage power to be switched. The problem posed by arcing may be especially acute at the time that contacts are being broken apart, for example, when a stationary contact and a moving contact are being disconnected. Arcing may occur between a power contact and ground, or between one or more power contacts. For example, in a three-phase switch, arcing may occur between one phase and ground, and/or between one or more of the three phases.

To reduce the incidence of arcing without increasing switch size, loadbreak switches often are submersed in a bath of dielectric fluid. The dielectric fluid is more resistive to arcing than is air. The dielectric fluid reduces but does not eliminate the distance required between contacts to suppress arcing. Hence, incidental arcing typically will occur until switch contacts are separated sufficiently to provide the required suppression distance. Although transient, such incidental arcing degrades the insulative qualities of the dielectric fluid by creating a path of carbonization elements and gas bubbles that is more conductive than the dielectric fluid. Repeated incidental arcing may bolster the conductive path, a path which eventually may provide a conduit for dangerous sustained arcing.

Sustained arcing may cause a loadbreak switch to fail catastrophically. More specifically, temperatures within the plasma formed by a sustained arc may reach tens of thousands of degrees Fahrenheit. Under sustained arcing, the dielectric fluid may vaporize and the metal contacts of the loadbreak switch may melt and/or vaporize, creating an expanding conductive cloud of high temperature ionized gas. As the conductive cloud expands, arcing may propagate to other contacts of the loadbreak switch which can create other fault paths between phases and phases to ground. Additionally, the conductive plasma and gases may expand explosively in an arc-blast as they are superheated by the sustained arcing. A breach in the seal of the equipment may result. In such an event, the arc-blast itself may exert a catastrophic force upon nearby surroundings. In addition to the superheated gases, the arc-blast may include molten metal and fragments of equipment transformed into projectiles.

SUMMARY

In one general aspect, a high-voltage loadbreak switch operates submersed in a dielectric fluid and is configured to switch one or more phases of power and/or one or more loads using one or more phase switches. To help suppress arcing between different phases or between a phase and ground, a dielectric baffle intervenes about entirely between different phase switches, or may be provided to separate a phase switch from ground. Each phase switching mechanism includes first and second stationary contacts. The first stationary contact is connected to a phase of a high-voltage power source. Each phase switching mechanism also includes a non-stationary contact. The non-stationary contact may be placed in a first position to electrically couple the first stationary contact to the second stationary contact, and in a second position to decouple the first stationary contact from the second stationary contact. The non-stationary contact may be coupled non-switchably to the second stationary contact. The region of motion of the first non-stationary contact between the first position and the second position includes an arcing region. The high-voltage loadbreak switch uses a fluid circulation mechanism to circulate dielectric fluid through the arcing region.

Implementations may include one or more of the following features. For example, the fluid circulation mechanism may disperse conductive impurities (e.g., carbonization elements and/or bubbles) accumulated within the arcing region from past arcing. Circulation of the dielectric fluid at a sufficient rate also may suppress arcing by increasing by about ten percent or more a length of dielectric fluid an arc must traverse to pass through the arcing region. Circulation also may provide an enhanced flow of dielectric fluid that has not been exposed to arcing to improve quickly the dielectric strength in the arcing region.

The fluid circulation mechanism may include a paddle or paddles configured to increase the dielectric fluid flowing through the arcing region. The paddle may be formed of a non-conductive material, such as, plastic or fiberglass. The paddle may be included as part of the non-stationary contact or may be physically separate from the contact. The paddle and the non-stationary contact may be included as part of a rotor that is coupled to a rotatable shaft. Alternatively, or in addition, the paddle may be mounted directly to the rotatable shaft. In any case, rotation of the shaft may rotate the non-stationary contact between the first position and the second position while causing the paddle to circulate the dielectric fluid through the arcing region.

In another implementation, the high-voltage loadbreak switch induces a convection current with a heating element to enhance circulation of the dielectric fluid through the arcing region.

Other features will be apparent from the description, the drawings, and the claims.

DESCRIPTION OF DRAWINGS

Like reference symbols in the various drawings indicate like elements.

DETAILED DESCRIPTION

For illustrative purposes, a high-voltage loadbreak switch, sometimes referred to as a selector or sectionalizing switch, is described that uses a fluid circulation mechanism to reduce arcing during disconnection (breaking) of high-voltage power. For clarity of exposition, the description begins with an account of switching mechanisms of the high-voltage loadbreak switch and of mechanisms employed to suppress arcing. The discussion proceeds from general elements of the mechanisms, and their high level relationships, to a detailed account of illustrative roles, configurations, and components of the elements.

Figure 1:
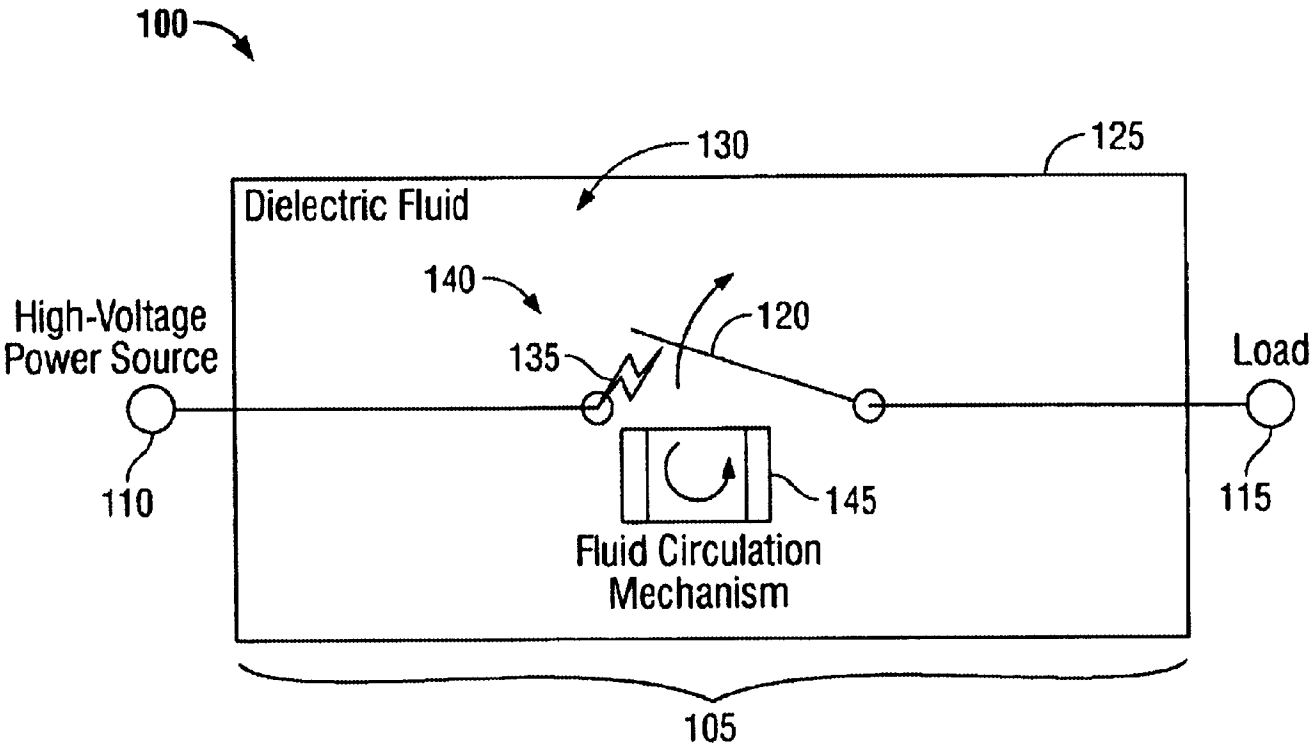
FIG. 1 is a schematic diagram of a high-voltage loadbreak switch with enhanced are suppression.

Referring to FIG. 1, a high-voltage loadbreak switch 100 defines an electrical path 105 between a high-voltage power source 110 and a load 115. The electrical path 105 includes a switching mechanism 120 configured to open or close the electrical path 105. The high-voltage loadbreak switch 100 also includes a casing 125 that holds elements of the high-voltage loadbreak switch 100 immersed in a dielectric fluid 130 (e.g., a mineral oil). The dielectric fluid 130 suppresses arcing 135 in an arcing region 140 when the switching mechanism 120 is opened to disconnect the load 115 from the high-voltage power source 110.

The ability of the high-voltage loadbreak switch 100 to suppress arcing is a function of the impedance and voltage presented between the open contacts of the switching mechanism 120. The overall impedance, in turn, may be determined based on the impedance per unit length presented by the dielectric fluid 130 and the length of the dielectric fluid 130 through which the current must travel to arc between the contacts of switching mechanism 120. Arcing may be suppressed, therefore, by increasing the dielectric strength of the dielectric fluid 130 and extending the path through the dielectric fluid 130 that an arc must travel.

In view of this, the high-voltage loadbreak switch 100 includes a fluid circulation mechanism 145. The fluid circulation mechanism 145 helps circulate the dielectric fluid 130 through the arcing region 140. Circulation of the dielectric fluid 130 through the arcing region 140 improves the strength of the dielectric fluid 130 in the arcing region 140 by removing conductive impurities caused by arcing (e.g., carbonization elements, and bubbles). Unless removed from the arcing region, these conductive impurities may facilitate continued or future arcing by providing a lower impedance path between the contacts of switching mechanism 120. Circulation of the dielectric fluid 130 through the arcing region 140 also may increase the length (e.g., by about ten percent or more) of the path through the dielectric fluid 130. The lengthening of the path that an arc must travel between contacts of the switching mechanism 120 improves the arc suppression of the switching operation.

Figure 2:
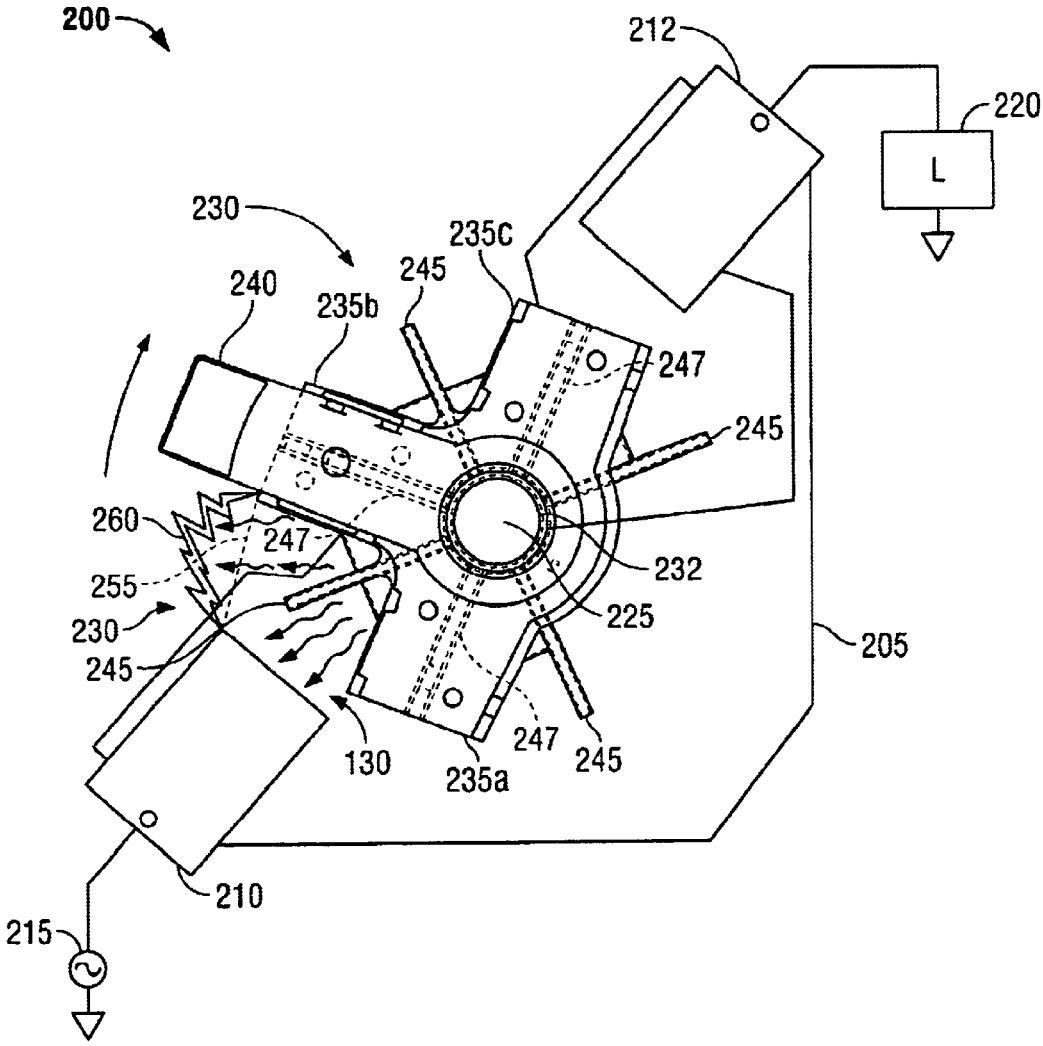
FIGS. 2 and 3 are front views of a switching mechanism that may be used to implement the high-voltage loadbreak switch of FIG. 1.
Figure 3:
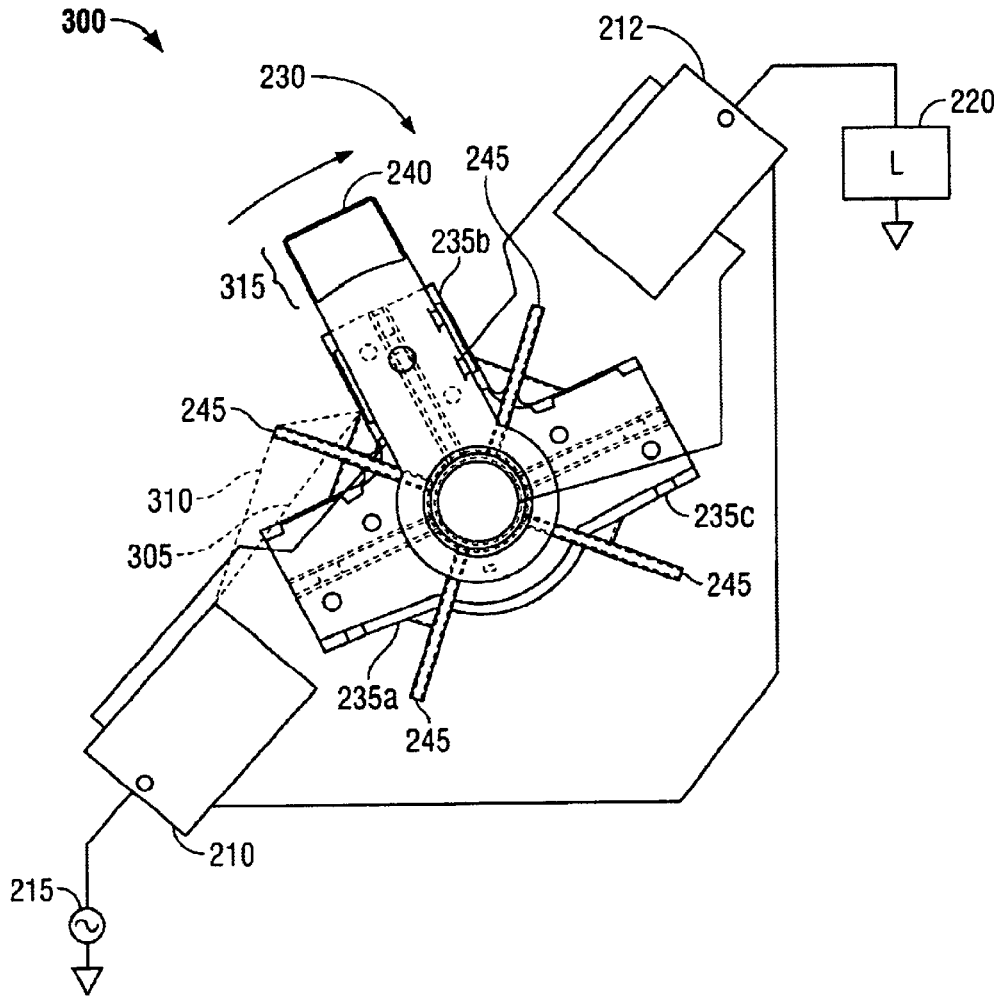

FIGS. 2 and 3 illustrate a rotating switching mechanism 200 with paddles that may be used to implement the high-voltage loadbreak switch of FIG. 1. FIGS. 2 and 3 each illustrate different aspects of the rotating switching mechanism 200. For brevity, the description of FIG. 3 omits material common to the description of FIG. 2.

Referring to FIG. 2, the rotating switching mechanism 200 includes a switch block 205 that supports elements of the rotating switching mechanism 200 in a desired spacing. The switch block 205 generally may be of any suitable shape, such as, for example, a triangular, square, or pentagonal shape. Switch block 205 is triangular shaped in the implementation shown. Two corners of the switch block 205 include, respectively, stationary contacts 210 and 212 (in other implementations, the third corner also includes a stationary contact). The first stationary contact 210 is connected to a high-voltage power source 215 while the second stationary contact 212 is connected to a load 220. The rotating switching mechanism 200 may be immersed in a dielectric fluid 130 within the case (tank) of a transformer or switchgear. The dielectric fluid may include, for example, base ingredients such as mineral oils or vegetable oils, synthetic fluids such as polyol esters, SF6 gas, and silicone fluids, and mixtures of the same.

The rotating loadbreak switch 200 includes a rotating center shaft 225. A rotor 230 is coupled to the rotating center shaft 225 and rotates based on rotation of the rotating center shaft 225. A center hub 232 may connect the rotor 230 non-switchably to a stationary contact 210 or 212. The rotor 230 includes retaining arms 235*a*–235*c* that are positioned at 90° angles relative to one another in a T-shaped configuration and that radiate from the radial axis of the rotor 230. Each of retaining arms 235*a*–235*c* is configured to retain a contact blade 240. In the implementation of FIG. 2, retaining arm 235*b* is populated with a contact blade 240 while retaining arms 235*a* and 235*c* are left unpopulated. This rotor configuration provides a single-blade switching mechanism. Other rotor configurations may be used, examples of which are detailed below with respect to FIGS. 4A–4E.

The rotor 230 may be rotated to bring the stationary contact 210 and the contact blade 240 into electrical contact, or to move the contact blade 240 apart from the stationary contact 210 to break that electrical contact. The rotor 230 also includes one or more paddles 245 that lie on the same radial axis of the rotor 230 as the retaining arms 235*a*–235*c*. The paddles 245 may be placed at angles, e.g., 45°, relative to the retaining arms 235*a*–235*c*. Each paddle 245 is configured to present a significant surface to a direction of rotation of the rotor 230 through the dielectric fluid 130. In addition, or in the alternative, the retaining arms 235*a*–235*c* may be configured with paddle-like features (e.g., ridges 247).

The rotor 230 may be rotated, for example, in a clockwise direction to break contact with the high-voltage power source 215 at the stationary contact 210. When the rotor 230 rotates, the paddles 245 cause the dielectric fluid 130 to circulate outward from the rotor 230 and through an arcing region 250. The outward circulation of the dielectric fluid 130 clears impurities from within the arcing region 250 that may reduce the ability of the dielectric fluid 130 to suppress arcing in the arcing region 250. For example, the outward circulation of the dielectric fluid 130 may disperse bubbles and/or carbonization elements created by arcing through the arcing region 250, and that otherwise would increase electrical conductance through the arcing region 250.

Outward circulation of the dielectric fluid 130 through the arcing region 250 also may cause an effective increase (e.g., an increase of about ten percent or more) in a length of the shortest available arc path 255, thus increasing the barrier presented to arcing. For example, absent circulation of the dielectric fluid 130, the line 255 may represent the shortest available arc path between the stationary contact 210 and the rotating contact 240. However, outward motion of the dielectric fluid 130 caused by rotation of the paddles 245 effectively may increase the length of the shortest available arc path 255, for example, to an effectively longer arc path represented conceptually by arc 260. To emphasize visually differences in effective path length, the arc path followed by arc 260 appears geographically longer than arc path 255. Nevertheless, the geographic length actually traversed by the arc 260 generally may be the same as that of arc path 255, while also effectively being longer—as is explained in more detail below.

Namely, even if the geographic paths an arc 260 traverses through moving dielectric fluid versus essentially non-moving dielectric fluid generally are the same, the length of dielectric fluid traversed (the effective distance) in the two cases may differ. Specifically, the effective distance may be determined based on a vector sum of a propagation velocity of the arc 260 through the dielectric fluid 130 and of a velocity of the dielectric fluid 130.

The effect is analogous to that displayed when a rowboat crosses a swiftly flowing river from one bank to a point directly opposite on the other bank. Even if the rowboat travels a shortest straight-line distance to arrive at the other bank, the rowboat must exert an upstream force counter to the downstream current. In sum, the rowboat is forced to travel a greater effective distance than if that same straight-line geographic distance were traveled and only still water intervened.

Referring to FIG. 3, for illustrative purposes the rotor 230 now is shown at a somewhat greater rotational angle than that at which it was shown in FIG. 2. The greater rotation of rotor 230 causes a paddle 245 to intrude into a shortest arcing path 305 between the stationary contact 210 and the base of the retaining arm 235*b* and rotating contact 240 (for simplicity of exposition, the effect of retaining arm 235*a* on path 305 is neglected, although that effect may be similar to the effect of the paddle 245). Because the paddle 245 is fabricated from a non-conducting material (e.g., a polymer, fiber-glass, and/or cellulosic material), the shortest path presented for arcing now extends around the paddle 245 as illustrated by the extended arc-path 310. By increasing the physical distance an arc must traverse between the stationary contact 210 and the rotating contact 240, the barrier to arcing also is increased.

Moreover, as the rotating contact 240 rotates away from the stationary contact 210, the paddle 245 may prevent an established arc from maintaining itself by "walking-down" the rotating contact 240 to shorten an otherwise increasing arc path. Specifically, when switching is initiated to break the contacts, the shortest arc path will lie between a start point at the stationary contact 210 and an end point at the outer end 315 of the contact blade 240. As the contact blade 240 rotates away, however, the initially shortest arc path becomes longest almost immediately. As rotation proceeds, a new shortest arc path (e.g., arc path 305) is defined based on an end point that moves progressively down from the outer end 315 of the contact blade 240 toward the base of the contact blade 240. An established arc may attempt to follow this changing shortest path by "walking down" the contact blade 240. As illustrated by FIG. 3, the non-conductive paddle 245 acts to suppress "walk down" by further increasing the shortest arc path as the contact blade 240 rotates away (e.g., compare paths 305 and 310). Further protection against arc "walk-down" may be provided by sheathing a lower portion of a contact blade 240 with a non-conducting material, and/or by fabricating and/or by sheathing a retaining arm 235 of the rotor 230 in a non-conductive material.

FIGS. 4A–4E illustrate other ways in which the rotor 230 may be configured to implement a rotary switching mechanism.

Figure 4A:
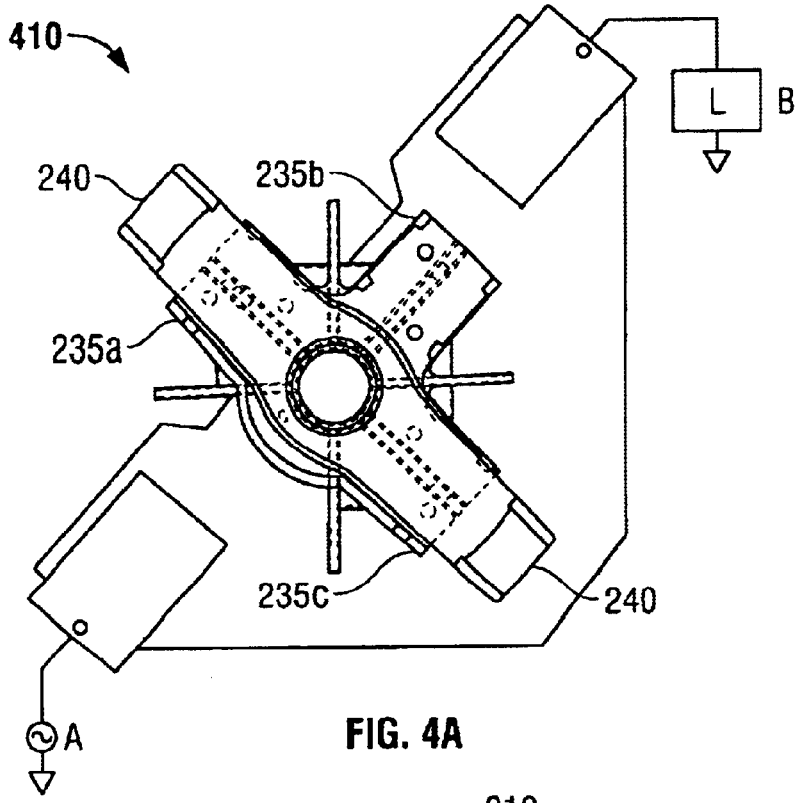
FIGS. 4A–4E are front views of additional exemplary switch configurations that may be used to implement the high-voltage loadbreak switch of FIG. 1.

Referring to FIG. 4A, a straight-blade switching mechanism 410 is shown. To configure the straight-blade switching mechanism 410, retaining arms 235*a* and 235*c* arc populated with contact blades 240, while retaining arm 235*b* is not populated with a contact blade. The straight-blade switching mechanism 410 is used, for example, to switch a high-voltage power source A and a load B.

Figure 4B:
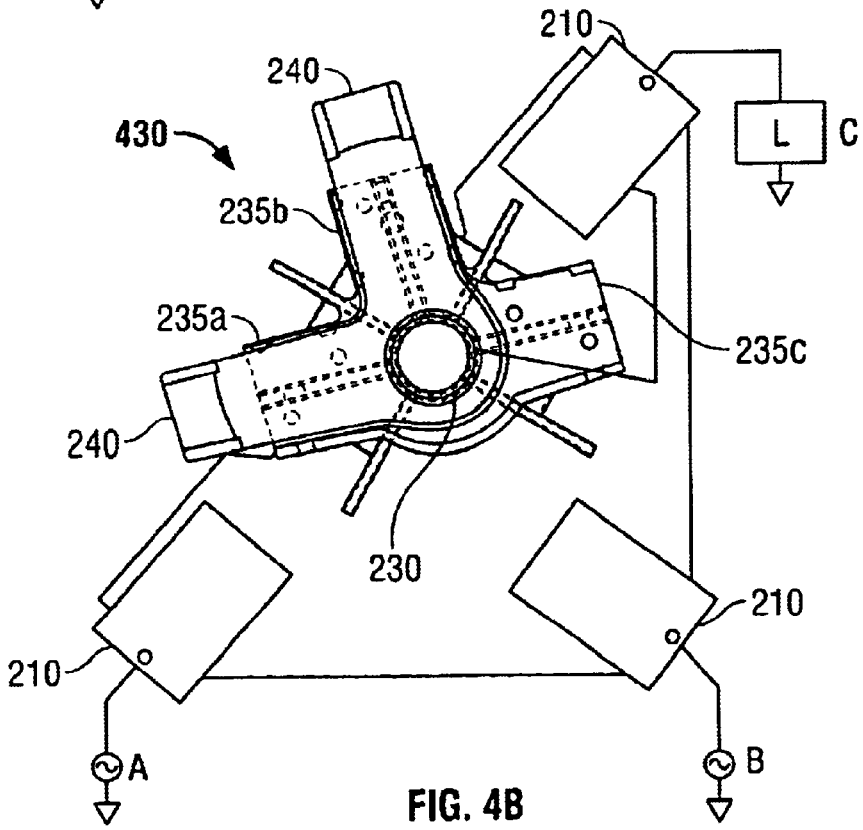

FIG. 4B shows a V-blade switching mechanism 430. The V-blade switching mechanism 430 populates retaining arms 235*a* and 235*b* with contact blades 240 to provide two rotating contacts of the same length at a 90° angle from each other. Three stationary contacts 210 also are provided. Two of the stationary contacts are connected to a first high-voltage power source A and to a second high-voltage power source B, respectively. The third stationary contact is connected to a load C (e.g., a transformer core-coil assembly) and also is connected to the switch hub 230. The V-blade switching mechanism 430 may feed load C from source A and/or from source B, and may provide a completely open position in which the load C is connected to neither source A nor source B. Specifically the V-blade switching mechanism 430 may select an open circuit; a circuit between source A and load C; a circuit between source B and load C; or a circuit between sources A and B, and load C. Other configurations of the V-blade switch are possible. For example, in an alternative implementation, the V-blade switching mechanism may be configured to switch two loads between one power source.

Figure 4C:
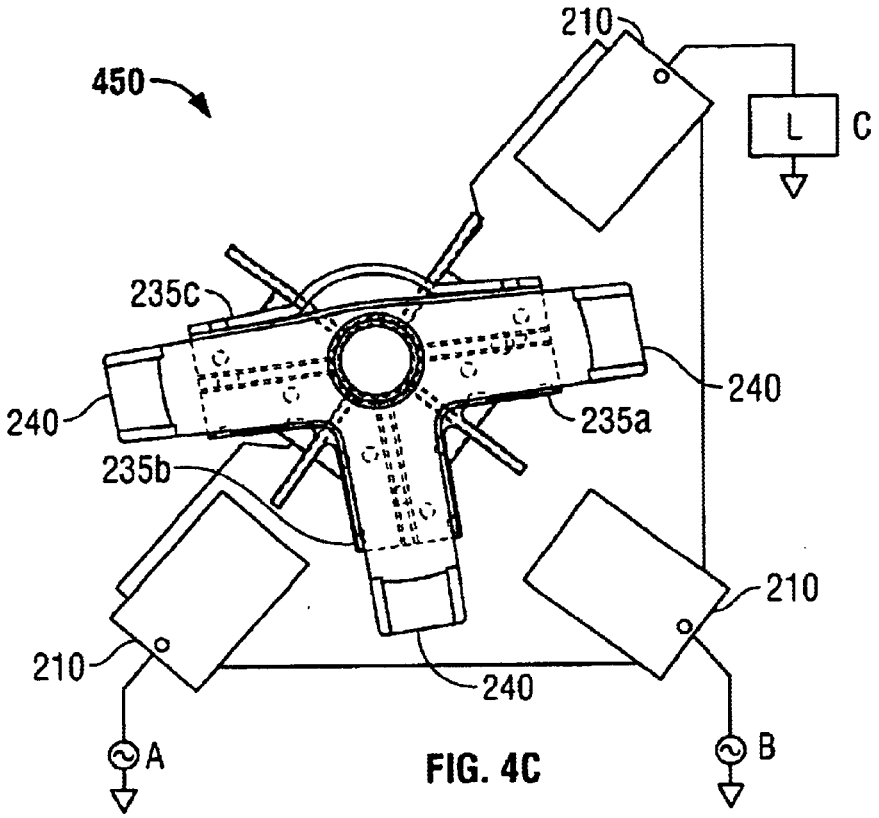

Referring to FIG. 4C, a T-blade switching mechanism 450 populates each of the retaining arms 235*a*–235*c* with a contact blade 240. Hence, the T-blade switching mechanism 450 provides three rotating contacts of the same length, each at a 90° angle from the other. Three stationary contacts 210 also are provided. Each stationary contact 210 is attached to a power source (e.g. source A or source B) or a load (e.g., load C), respectively. The T-blade switching mechanism 450 may connect the load C to source A and/or to source B. Alternatively, the T-blade switching mechanism 450 may connect together sources A and B while leaving the load C connected to neither source. In sum, the T-blade switching mechanism 450 may form circuits between sources A and B; source A and load C; source B and load C; or sources A and B and load C. Other configurations of the T-blade switch are possible. For example, in an alternative implementation, the T-blade switching mechanism may be configured to switch two loads between one power source.

Figure 4D:
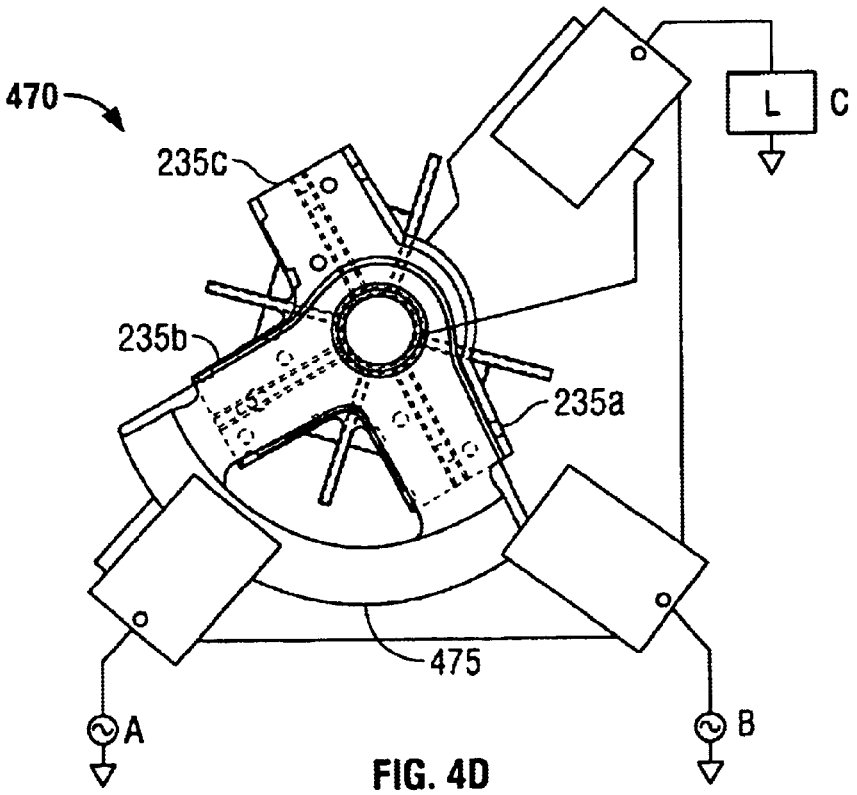
Figure 4E:
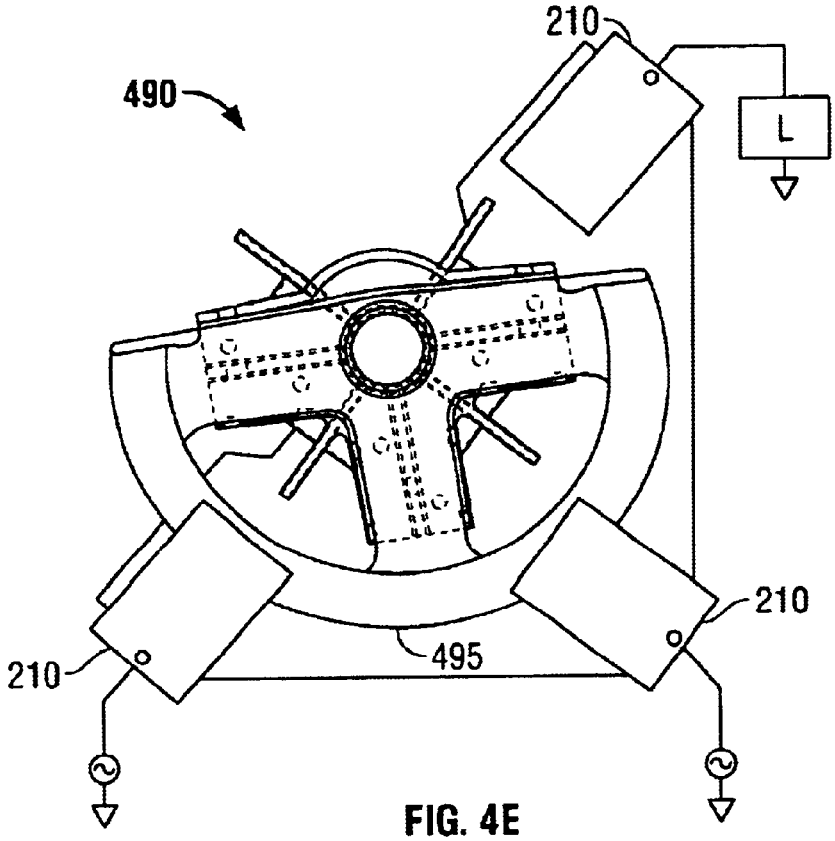

FIGS. 4D–4E illustrate V-blade and T-blade configurations of make-before-break (MBB) switching mechanisms 470 and 490. In a make-before-break switching mechanism, a rotating electrical contact is sized such that, when a load is switched between a first and a second power source, coupling of the first power source to the load is not broken until the second power source is coupled to the load. In sum, the make-before-break switching mechanism ensures that a first connection is not broken until after a second connection has been made. The power sources may be synchronized to not create a power fault during the time that both the first connection and the second connection are maintained while switching. Moreover, with respect to either the V-blade or the T-blade switching mechanisms 470, 490, other switching configurations may be used. For example, the switching mechanisms 470 and 490, may be configured to switch two loads between a single power source.

Referring to FIG. 4D, a make-before-break V-blade switching mechanism 470 includes an arc-shaped rotating contact 475 that populates retaining arms 235*a* and 235*b*. The MBB V-blade switching mechanism 470 may be used, for example, in a high-voltage application in which it is desired to switch a load C from an initial power source (e.g., source A) to an alternate power source (e.g., source B) without interruption. To switch as described, the load C may be connected to a stationary contact that also is connected to the hub.

Referring to FIG. 4E, a make-before-break T-blade switching mechanism 490 includes an arc-shaped rotating contact 495 similar generally to the rotating contact 475 of the MBB V-blade switching mechanism 470, but describing a greater arc. The switching capability of the MBB T-blade switching mechanism 490 is similar to that of a standard T-blade switching mechanism (e.g., T-blade switching mechanism 450) but with added make-before-break functionality. The rotating contact 495 describes a semi-circular arc and is sized such that it can electrically couple three stationary contacts 210 before breaking a previous connection. For example, the MBB T-blade switching mechanism 490 may be actuated to complete a connection between sources A and B and load C. Alternatively, the MBB T-blade switching mechanism 490 may complete a circuit between any two of source A, source B, and load C.

Figure 5:
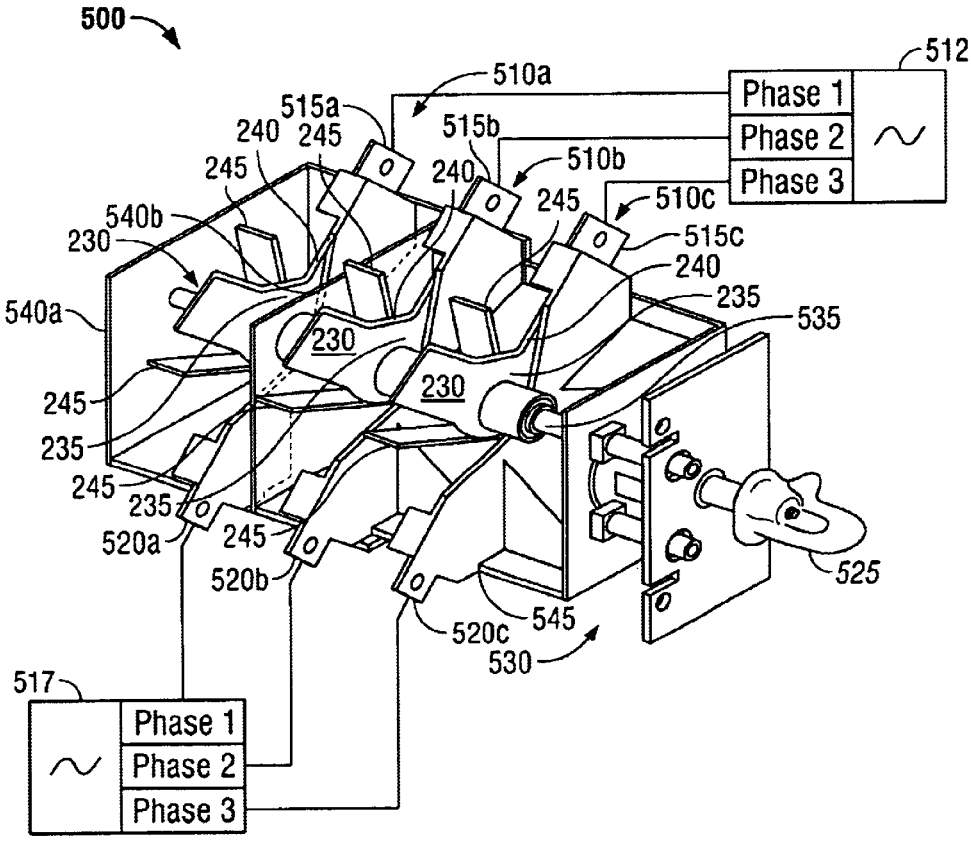
FIG. 5 is a perspective view of a three-phase switch that may be used to implement the high-voltage loadbreak switch of FIG. 1 while providing enhanced phase-to-phase and/or phase-to-ground arc suppression.

FIG. 5 illustrates a three-phase power switch 500 that includes three rotating switches 510*a*–510*c* with paddles 245 (by way of example, any of the switching mechanisms described previously might be used as a rotating switch 510). Each of rotating switches 510*a*–510*c* also includes a rotor 230 with retaining arms 235 and at least one contact blade 240. Each of rotating switches 510*a*–510*c* is configured to switch a single phase (e.g., a first phase) of one or more power sources, and/or one or more loads.

For example, a first high-voltage power source 512 might connect its first phase to stationary contact 515*a*, its second phase to stationary contact 515*b*, and its third phase to stationary contact 515*c*. A second high-voltage power source 517 might connect its first, second, and third phases to stationary contacts 520*a*–520*c*, respectively. Thus, a first switch component 510*a* may select alternatively between the first phase of the first and second power sources (e.g., between stationary contacts 515*a* and 520*a*), a second switch component 510*b* may alternatively select between the second phase of the first and second power sources (e.g., between stationary contacts 515*b* and 520*b*), and a third switch component 510*c* may alternatively select between the last phase of the first or second power sources (e.g., between stationary contacts 515*c* and 520*c*).

The three-phase power switch 500 may be configured to switch simultaneously each of the rotating switches 510*a*–510*c*. More specifically, a handle 525 may be rotated to charge springs 530 that are coupled to a shaft 535. The shaft 535 may connect to each of rotating switches 510*a*–510*c*. For example, the shaft 535 may extend through a rotational axis of each rotating switches 510*a*–510*c*. When released, the springs 530 may cause the shaft 535 to rotate the rotating switching mechanisms 510*a*–510*c* simultaneously, at a speed independent of the speed of the operator. Alternatively, each of rotating switching mechanisms 510*a*–510*c* may include a separate actuator to actuate each of rotating switches 510*a*–510*c* based on rotation of shaft 535. In either event, the three-phase power switch 500 may be used to switch simultaneously from the three phases of the first power source 512 (e.g., stationary terminals 515*a*–515*c*) to the three phases of the second power source 517 (e.g., stationary terminals 520*a*–*c*). Alternatively, the three-phase power switch 500 may be configured to switch two loads between a single three-phase power source.

The three-phase power switch 500 also includes baffles 540*a* and 540*b* that intervene about entirely between the different phases. More specifically, a first baffle 540*a* separates rotating switch 510*a* (phase one) from rotating switch 510*b* (phase two). The second baffle 540*b* separates rotating switch 510*b* (phase two) from rotating switch 510*c* (phase three). The baffles 540*a* and 540*b* are fabricated from a non-conductive material, such as, for example, corrugated paper or cardstock, fiberglass, or plastic. The baffles 540*a* and 540*b* may be provided separately. Alternatively, the baffles 540*a*and 540*b* may be integrated, for example, with the switch block 545, the shaft 535, and/or a rotor 230. In either event, the baffles 540*a* and 540*b* form an electrical barrier to suppress arcing between the separate phases, or between a phase and ground, that otherwise might cause damage to the three-phase power switch 500. By preventing an initial phase-to-phase or phase-to-ground arc from occurring, the baffles 540*a* and 540*b* may increase safety and reliability of the three-phase power switch 500.

Figure 6:
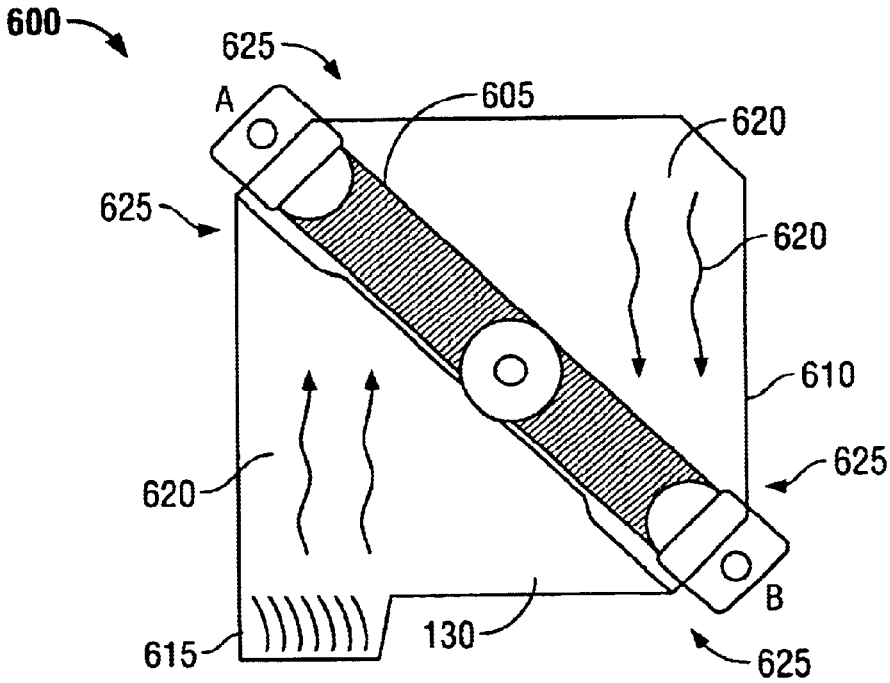
FIG. 6 is a front view of a switch and a convection circulation mechanism that may be used to implement the high-voltage loadbreak switch of FIG. 1.

FIG. 6 illustrates an additional rotating switching mechanism 600 that may be used to implement the high-voltage loadbreak switch of FIG. 1. The rotating switching mechanism 600 includes a contact rotor (e.g., straight blade rotor 605). The straight blade rotor 605 is configured to connect or disconnect a first stationary contact A and a second stationary contact B in a manner similar to that described previously. A casing 610 retains components of the rotating switching mechanism 600 submerged in a dielectric fluid 130. The rotating switching mechanism 600 circulates the dielectric fluid 130 using a convection mechanism. More specifically, the rotating switching mechanism 600 includes a heating element 615 configured to induce a convection current 620 in the dielectric fluid 130 by heating the dielectric fluid 130 at a lower portion of the casing. The heated dielectric fluid 130 rises from the lower portion of the casing 610 and causes cooler dielectric fluid 130 of an upper portion of the casing 610 to settle (i.e., the convection current 620 is induced). In this manner, the convection current 620 causes the dielectric fluid 130 to circulate and disperse a buildup of impurities from within arcing regions 625. The rotating switching mechanism 600 employ convection circulation alone or in combination with other methods or systems of arc suppression, such as, for example, a paddle and/or a baffle.

Other implementations are within the scope of the following claims.

What is claimed is:

1. A loadbreak switch for switching a high-voltage power source while submersed in a dielectric fluid, the loadbreak switch comprising:

a first stationary contact configured to couple to a high-voltage power source;

a second stationary contact;

a non-stationary contact configured to be placed in a first position to couple electrically the first stationary contact to the second stationary contact, and in a second position to decouple electrically the first stationary contact and the second stationary contact, wherein a region of motion of the non-stationary contact between the first position and the second position comprises an arcing region; and a fluid circulation mechanism configured to circulate the dielectric fluid through the arcing region.

2. The switch of claim 1 further comprising a non-switching connection configured to couple together electrically the non-stationary contact and the second stationary contact.

3. The switch of claim 1 wherein the fluid circulation mechanism comprises a paddle configured to circulate the dielectric fluid through the arcing region.

4. The switch of claim 3 wherein the paddle comprises an element of the first non-stationary contact.

5. The switch of claim 3 further comprising a rotatable shaft coupled to the first non-stationary contact and the paddle and configured to rotate the first non-stationary contact between the first position and the second position while causing the paddle to circulate the dielectric fluid through the arcing region.

6. The switch of claim 5 wherein the first non-stationary contact and the paddle comprise a first rotor.

7. The switch of claim 6 wherein the first non-stationary contact and the paddle comprise spaced-apart elements of the first rotor.

8. The switch of claim 5 wherein the paddle is coupled directly to the rotatable shaft.

9. The switch of claim 1 wherein the fluid circulation mechanism is configured to circulate the dielectric fluid at a rate adequate to increase by about ten percent or more a length of a path through the dielectric fluid that an arc must travel to pass through the arcing region.

10. The switch of claim 1 wherein the fluid circulation mechanism is configured to circulate the dielectric fluid at a rate adequate substantially to disperse within a predetermined length of time impurities of the dielectric fluid from within the arcing region.

11. The switch of claim 10 wherein the impurities of the dielectric fluid comprise bubbles formed by arcing.

12. The switch of claim 10 wherein the impurities of the dielectric fluid comprise carbonization elements formed by arcing.

13. The switch of claim 3 wherein the paddle comprises a non-conducting material.

14. The switch of claim 13 wherein the paddle is configured to suppress an arc from "walking down" the first non-stationary contact as the first non-stationary contact rotates from the first position to the second position.

15. The switch of claim 1 wherein the fluid circulation mechanism comprises a heating element configured to circulate the dielectric fluid through the arcing region by inducing a convection current in the dielectric fluid.

16. The switch of claim 1 wherein:

the high-voltage power source comprises a poly-phase power source; and the switch comprises a first stationary contact, a second stationary contact and a non-stationary contact associated with each phase.

17. The switch of claim 1 wherein the dielectric fluid comprises a mineral oil.

18. The switch of claim 1 wherein the dielectric fluid comprises a vegetable oil.

19. The switch of claim 1 wherein the dielectric fluid comprises a polyol ester.

20. The switch of claim 1 wherein the dielectric fluid comprises an SF6 gas.

21. The switch of claim 1 wherein the dielectric fluid comprises a silicone fluid.

22. A poly-phase loadbreak switch for switching a high-voltage poly-phase power source, the switch comprising:

a first phase switch configured to switch a first phase of the high-voltage poly-phase power source;

a second phase switch configured to switch a second phase of the high-voltage poly-phase power source; and a first baffle configured to separate about all of an arcing region of the first phase switch from about all of an arcing region of the second phase switch to suppress arcing between the first phase switch and the second phase switch, wherein the first baffle comprises a non-conductive material.

23. The poly-phase loadbreak switch of claim 22, the switch further comprising:

a third phase switch configured to switch a third phase of the high-voltage poly-phase power source;

a second baffle configured to separate about all of a second arcing region of the second phase switch from about all of an arcing region of the third phase switch to suppress arcing between the second phase switch and the third phase switch, wherein the second baffle comprises a dielectric material.

24. The poly-phase loadbreak switch of claim 22 wherein the poly-phase loadbreak switch is configured to be operated in a dielectric fluid and further comprises a fluid circulation mechanism to circulate the dielectric fluid.

25. The poly-phase loadbreak switch of claim 24 wherein the fluid circulation mechanism comprises a paddle.

26. A three-phase loadbreak switch for switching a high-voltage three-phase power source while submersed in a dielectric fluid, the switch comprising:

a first rotating switch configured to switch a first phase of the high-voltage three-phase power source;

a second rotating switch configured to switch a second phase of the high-voltage three-phase power source;

a third rotating switch configured to switch a third phase of the high-voltage three-phase power source;

a first baffle configured to intervene about entirely between the first rotating switch and the second rotating switch to suppress arcing between the first phase and the second phase of the high-voltage three-phase power source;

a second baffle configured to intervene about entirely between the second rotating switch and the third rotating switch to suppress arcing between the second phase and the third phase of the high-voltage three-phase power source;

wherein the first, second, and third rotating switches each comprise a paddle configured to circulate the dielectric fluid.

* * * * *